United States Patent [19]

Woolfolk

[11] 4,249,883

[45] Feb. 10, 1981

[54] AUTOMATIC DAMPER DEVICE

[75] Inventor: Charles E. Woolfolk, Clarksdale, Miss.

[73] Assignee: Save Fuel Corporation, Clarksdale, Miss.

[21] Appl. No.: 808,137

[22] Filed: Jun. 20, 1977

[51] Int. Cl.[3] ..... F23N 3/00

[52] U.S. Cl. ..... 431/20; 236/1 G

[58] Field of Search ..... 236/1 G; 126/285 B, 126/286; 110/163; 431/20

[56] References Cited

U.S. PATENT DOCUMENTS

| | | | |
|---|---|---|---|
| 2,037,363 | 4/1936 | Branche | 126/285 B |
| 2,085,912 | 7/1937 | Lencke et al. | 126/285 B |
| 2,117,787 | 5/1938 | Bock | 126/285 B |
| 3,090,558 | 5/1963 | Vaughn | 236/74 |
| 3,273,625 | 9/1966 | Holtzman et al. | 431/20 |
| 3,580,238 | 5/1971 | Diehl | 110/163 |
| 4,037,123 | 8/1977 | Frankel | 126/285 B |

*Primary Examiner*—William E. Wayner

*Attorney, Agent, or Firm*—Charles B. Haverstock

[57] ABSTRACT

This invention relates to an automatic damper device for use in exhaust flues, such as flues of combustion devices such as furnaces and water heaters, devices such as air conditioners, and the like, to prevent undesirable loss of hot air or cold air out the flues during periods when no combustion is taking place. The damper has a rotatable damper plate held in normal open position which provides a desired fail safe in the open position assurance. The damper is also adapted to remain in the open position during periods of combustion in the furnace or water heater but otherwise be retained in the closed position to avoid the unnecessary loss of heated air or cooled air.

3 Claims, 6 Drawing Figures

INVENTOR
CHARLES E. WOOLFOLK

INVENTOR
CHARLES E. WOOLFOLK

AUTOMATIC DAMPER DEVICE

PRIOR ART

There are many damper devices in existence. Generally, the known devices are designed to produce optimum draft conditions when combustion is taking place and to be closed with electric motors or other means when no combustion is taking place. A particularly useful device is disclosed and claimed in U.S. Pat. No. 3,580,238. This patent and the references cited therein are pertinent prior art. In addition, U.S. Pat. No. 3,090,558 discloses a construction having a movable damper plate fixedly mounted on a shaft which extends across the inside of a flue section. Further, U.S. Pat. No. 2,117,787, U.S. Pat. No. 2,037,363 and U.S. Pat. No. 2,085,912 also show various damper control devices. However, none of these devices have structural and operational features like those disclosed and claimed herein.

THIS INVENTION

This invention relates generally to air control systems which utilize forced air for heating, cooling or both.

More specifically, this invention relates to an automatic damper device characterized by means for controlling the discharge from an exhaust flue of the products of combustion of a combustion device such as a furnace, or water heater or air conditioner or other similar devices. The invention comprises an open ended tubular flue section adapted to be installed as part of an exhaust flue, a frame member formed by connected semicircular portions, the frame member being mounted to the inside of the flue section, a shaft member rotatably mounted in the frame in position to extend across the frame member and across the inside of the flue section, the shaft extending out through at least one side of the open ended tubular flue section, a damper plate fixedly mounted on the shaft and movable therewith between a closed position extending across the flue section and engageable to some extent around the periphery thereof with the frame member to substantially restrict communication through the flow section, and an open position angularly related to the closed position to provide communication through the flue section, means mounted outside of the flue section and operatively connected to the shaft for moving the shaft and the attached damper plate between its open and closed positions, the shaft moving means including a cam attached to the shaft and solenoid motor means energizable in response to the occurrence of the end condition of a combustion cycle of the furnace or other device, the solenoid motor means having an armature pivotally connected to the cam at a location spaced outwardly from the shaft, energization of the motor means operating to rotate the shaft and move the damper plate from its open to its closed position, and means including a spring connected between the shaft and the flue section, the spring normally biasing the damper plate toward its open position in opposition to the motor means. The present device also includes switch means under control of the cam, the switch being normally open but closing when the damper plate is in its open position.

This invention is further characterized by an automatic damper device wherein the device has switch means adapted to operate in connection with the operation of the thermostat control means to energize the solenoid motor means to move the damper plate from its normally open position into its closed position when the thermostat control means are switched from heating to air conditioning.

The novel invention disclosed herein is also adapted to operate with water heaters and other devices which have combustion and non-combustion cycles wherein the water heater is vented to the same or to a different stack from the furnace. In this instance, there is provided further switching means adapted to cancel the energizing of the solenoid motor means thereby allowing the spring to move the damper plate into its normally open position when the thermostat control means are set for controlling air conditioning and the water heater is adapted to utilize the same exhaust flue as the air conditioning unit.

Since the fail safe in the open position provision of this invention requires that the solenoid motor be used to retain the damper plate in the closed position there is a requirement for some power, albeit very little power, during those times when the damper plate is being held in closed position. This means that the damper plate will be held in its closed position at all times except when combustion is going on in the furnace or water heater. Once the thermostat is switched from the heating cycle to the air conditioning cycle the circuitry to the furnace is deactivated and inoperative and at these times it would be impossible for the furnace to ignite and go into a combustion cycle.

A further optional but novel feature of the present device which incorporates a fail safe in the open position provision is the further provision of a unique counter balance built into the damper plate in combination with the position of the damper plate in the device. This means that the damper plate is constructed to be slightly unbalanced in weight and positioned in the device so that the slight weight unbalance will cause the damper to open by gravity if everything fails, including the spring which holds the damper in normal open position. The fail safe in the open position assurance therefore is guaranteed for all possible failures.

DETAILED DESCRIPTION

The novel invention disclosed and claimed herein is an improvement on the device disclosed and claimed in U.S. Pat. No. 3,580,238. Many automatic damper devices manufactured according to the disclosure in this patent are in use in the United States and other countries. Such automatic damper devices have been commercially successful and no failures resulting in damage to the users are known. However, use of these damper control devices have not reached maximum commercialization for various reasons including the fact that such devices fail safe in the closed damper position. Although there have been no known accidents where the fault was with the automatic damper device, concern has been expressed that such a device could fail in the closed position resulting in temporary loss of heat and inconvenience to the users. These and other problems and concerns are alleviated by the invention disclosed and claimed in this application which is specifically adapted to fail safe in all conditions in the open position.

The basic structure of the present invention is lucidly set forth in U.S. Pat. No. 3,580,238 and the description of this improvement can best be understood when read in connection with the description in the patent, although there are many important novel distinctions between the devices as will become evident from the specification and drawings. To the extent possible, the drawings in this application will use the same numbering system used in the reference patent.

It is therefore a principal object of the present invention to minimize the loss of conditioned hot or cold air through an exhaust outlet.

Another principal object is to provide an automatic damper device which will always fail in its open position.

Another object is to reduce the operating cost of furnaces, air conditioners, water heaters and other such combustion devices.

Another object is to provide automatic damper control means which substantially increase the efficiency and reduce the wear and tear on furnaces and other combustion devices.

Another object is to provide a damper control for furnaces and like devices which is extremely safe to use.

Another object is to minimize waste and/or reduce the fuel consumption of furnaces, space heaters, hot water heaters, air conditioners and like devices.

Another object is to provide automatic damper means which remain closed to prevent undesirable loss of heat during periods when no combustion is taking place.

Another object is to provide a relatively inexpensive automatic damper device which can be installed in new as well as existing furnace flues and the like.

Another object is to provide an automatic flue control device which must be in an open position before a combustion cycle can take place.

Another object is to provide automatic flue damper means which are relatively resistant to corrosion and can tolerate extremes in temperature including relatively high temperatures.

Another object is to provide damper means which are relatively quiet operating.

Another object is to provide damper means which require relatively little maintenance and repair.

Another object is to provide automatic damper means which include fail safe electrical interlock means.

These and other objects and advantages of the present device will become apparent after considering the following detailed specification in conjunction with the drawings, wherein.

Figure 1:
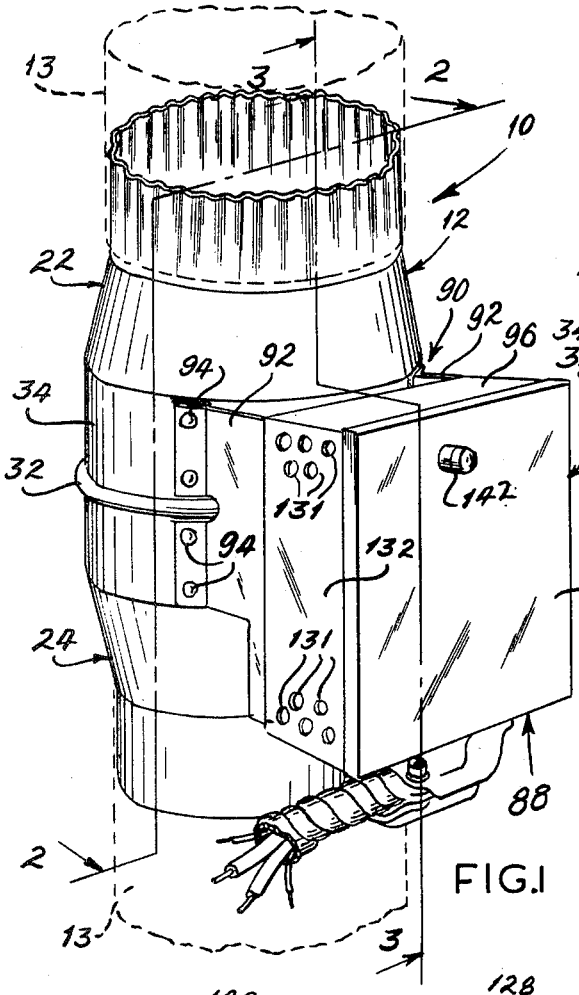
FIG. 1 is a perspective view of automatic damper means constructed according to the present invention.

Referring to the drawings more particularly by reference numbers, the number 10 in FIG. 1 refers to an automatic damper device constructed according to the present invention. The device 10 includes a flue assembly 12 for installing in a furnace or like flue 13 shown in dotted outline, and a control assembly 14 connected thereto. A rotatable shaft 16 extends from the control assembly 14 through the flue assembly 12 and the portion of the shaft that extends through the flue assembly 12 has a damper plate 18 mounted thereon which moves with the shaft 16 between open and closed positions as will be explained. In the closed position, the damper plate 18 is in close proximity to be in contact with an annular ring or frame member 20 around most of its periphery within the flue assembly 12. The open position of the damper plate 18 is shown in FIG. 2 in solid outline, and the closed position in dotted outline although in the closed position there is preferably provision for some leakage around the periphery between the damper plate 18 and the frame 20.

The flue assembly 12 is constructed to be mounted in the outlet flue of a furnace or like device and includes upper and lower flue sections 22 and 24, respectively which are shown as being round and tubular. The lower pipe section 24 includes a cylindrical lower portion 26 which is of a proper diameter to mate with the inside of one end of a standard section of flue pipe 13 shown in dashed outline in FIG. 1. The lower section 24 also has a large diameter cylindrical portion 28 which is connected to the portion 26 by a gradually tapered portion 30 therebetween. The larger diameter cylindrical portion 28 of the lower flue section 24 also has an outwardly extending annular abutment portion 32 formed therein near the center in position to abut the bottom edge of the upper flue section 22 to aid in aligning the two sections 22 and 24 during assembly thereof.

Figure 3:
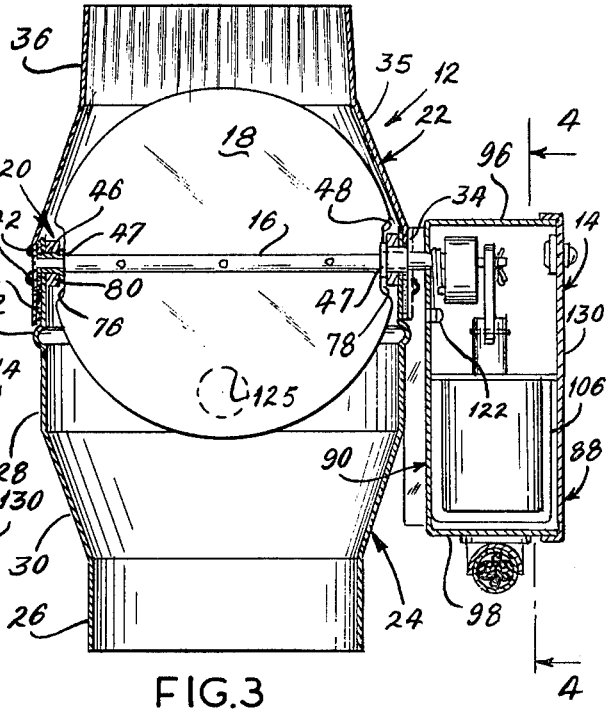
FIG. 3 is a cross-sectional elevational view taken on line 3—3 of FIG. 1.
Figure 2:
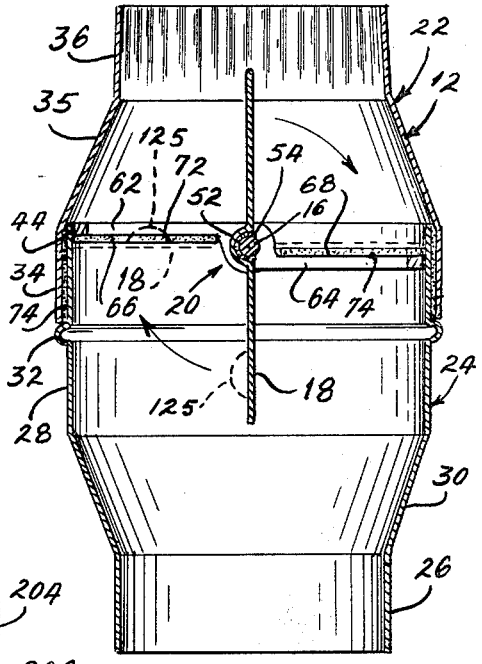
FIG. 2 is a cross-sectional elevational view taken on line 2—2 of FIG. 1 showing the damper plate open in solid outline and closed in dotted outline.

The upper flue section 22 is similar to the lower flue section 24 and includes a lower cylindrical portion 34 which cooperates with the cylindrical portion 28 as shown in FIGS. 2 and 3, a tapered portion 35 connected thereto, and a smaller diameter upper portion 36 which is properly sized and preferably also slightly tapered to be easily inserted into the end of an adjacent section of a flue pipe in which the subject device is installed in a well known manner. The larger diameter portion 34 of upper flue section 22 is sized to be slightly larger in diameter than the portion 28 of lower section 24 with which it mates so that when assembled, the section 22 overlaps a portion of the section 24 down to the abutment portion 32.

The flue assembly 12 is formed to be larger in diameter in the center portion thereof than the diameter of the flue in which it is installed so that when the damper plate 18 is open the cross-sectional flow passages thereby is at least as large as the flow passage of the flue pipe 13. This is done so that when the damper 10 is open, it will not restrict the normal flow of exhaust products past the damper plate 18. The tapered portions 30 and 35 of the sections 24 and 22 are also gradually tapered as shown to minimize undesirable turbulence and back pressure that might otherwise occur.

The annular ring or frame member 20 is fixedly mounted within the flue assembly 12 in the area of overlapped end portions of the sections 22 and 24 and is attached to the sections by rivets 42 or similar means which are shown extending through the sections 22 and 24 and through the frame 20. In the preferred embodiment it is also desirable to include a layer of insulating material such as a layer of silicon rubber 44 to seal the space between the frame 20 and the adjacent pipe section 24 and to some extent to reduce or eliminate any noise which might be generated by metal-to-metal contact therebetween.

The shaft 16 on which the damper plate 18 is mounted extends across the space defined within the frame 20 and is rotatably journaled to the frame 20 by bearing means which are shown as including flanged sleeve bearing members 46 (FIGS. 3 and 5) which are constructed of a material such as Teflon (a fluorocarbon resin marketed by E. I. du Pont de Nemours & Co.). Flanges 47 of the sleeve bearings 46 extend from the frame 20 inwardly to adjacent to the damper plate 18 to position the damper plate centrally in the frame 20 and to minimize lateral movement thereof. Teflon and similar type bearing materials have extremely low coefficients of friction even without lubrication and also have excellent resistance to adverse environmental conditions such as are caused by temperature extremes and exposure to chemicals such as are present in the exhaust fumes of furnaces and like devices and therefore are particularly suited to this purpose. The other components of the flue pipe assembly 12 are also preferably constructed from materials which are relatively unaffected by the heat and the corrosive constituents of the combustion products. For example, in a preferred embodiment of the subject device 10, the flue sections 22 and 24 are fabricated from chrome and nickel plated heavy gauge steel while the shaft 16, damper plate 18 and the frame 20 are fabricated from aluminum or like materials.

The damper plate 18 is preferably substantially round and flat being somewhat smaller in diameter than the inside diameter of the flue section portion 28 so as to be free to move without rubbing or binding. The damper plate 18 may also be larger or smaller in diameter than the inner diameter of the frame 20, depending on how much leakage is desired when closed, and the damper plate 18 has a round channel 52 formed on a diameter thereof which channel cooperates with and receives the shaft 16. An optional strip of sound-deadening insulation 54 may be positioned between the shaft 16 and the channel 52 to further deaden the sound of the damper plate when it moves. The damper plate 18 is fixedly connected to the shaft 16 by suitable fastener means such as nuts and bolts 56 which when drawn up tight compress the optional insulation layer 54 between the channel 52 and the shaft 16.

The frame 20 is constructed of two integral offset semicircular portions 62 and 64 (FIG. 2) having parallel surfaces 66 and 68 each engageable with or adjacent to approximately half of the periphery of the damper plate 18 when the device 10 is closed. However, as will be explained later, the positions of the offset portions 62 and 64 in the present construction are reversed as compared to their positions in the construction disclosed in U.S. Pat. No. 3,580,238. When the plate 18 is in its closed position it may engage optional somewhat compressible insulating overlayers 72 and 74 attached respectively to the opposite surfaces 66 and 68 on the frame member 20 to provide a relatively airtight connection therebetween although as explained this is not essential and may actually not be desired. The compressible overlayers 72 and 74 when used are preferably constructed from a material such as silicon rubber or a sponge material which is relatively unaffected by the heat and the chemicals normally contained in exhaust gases. The overlayers may also help to prevent the damper from becoming frozen to the frame during periods of prolonged nonuse. The frame 20 also serves to rigidly maintain the proper round cross-sectional shape of the flue pipes 22 and 24, thus assuring that a proper tolerance is maintained between the damper plate 18 and the flue sections at all times.

The damper plate 18 has arcuate peripheral cutouts 76 and 78 formed at opposite ends of the rounded channel portion 52 in which the shaft 16 is positioned. These cutouts provide clearances between the damper plate 18 and the portions 80 of the frame member 20 in which the bearings 46 for the shaft 16 are located. Portions of the cutouts 76 and 78 also form bearing surfaces adjacent to the flanges 47 which are part of the bearings 46 and help to maintain the damper plate 18 in a centered portion in the flue assembly 12. The cutouts 76 and 78 may also be slightly larger than necessary to provide some operating clearance and to allow controlled amounts of combustion products such as those generated by a pilot flame in the combustion device or amounts of raw or unburned gas such as might be present if the pilot flame went out to pass by the damper plate 18 even when it is in its closed position as during the air conditioning instead of the heating season. An orifice 82 (FIG. 5) may also optionally be formed in the damper plate 18 for the same purposes.

Figure 5:
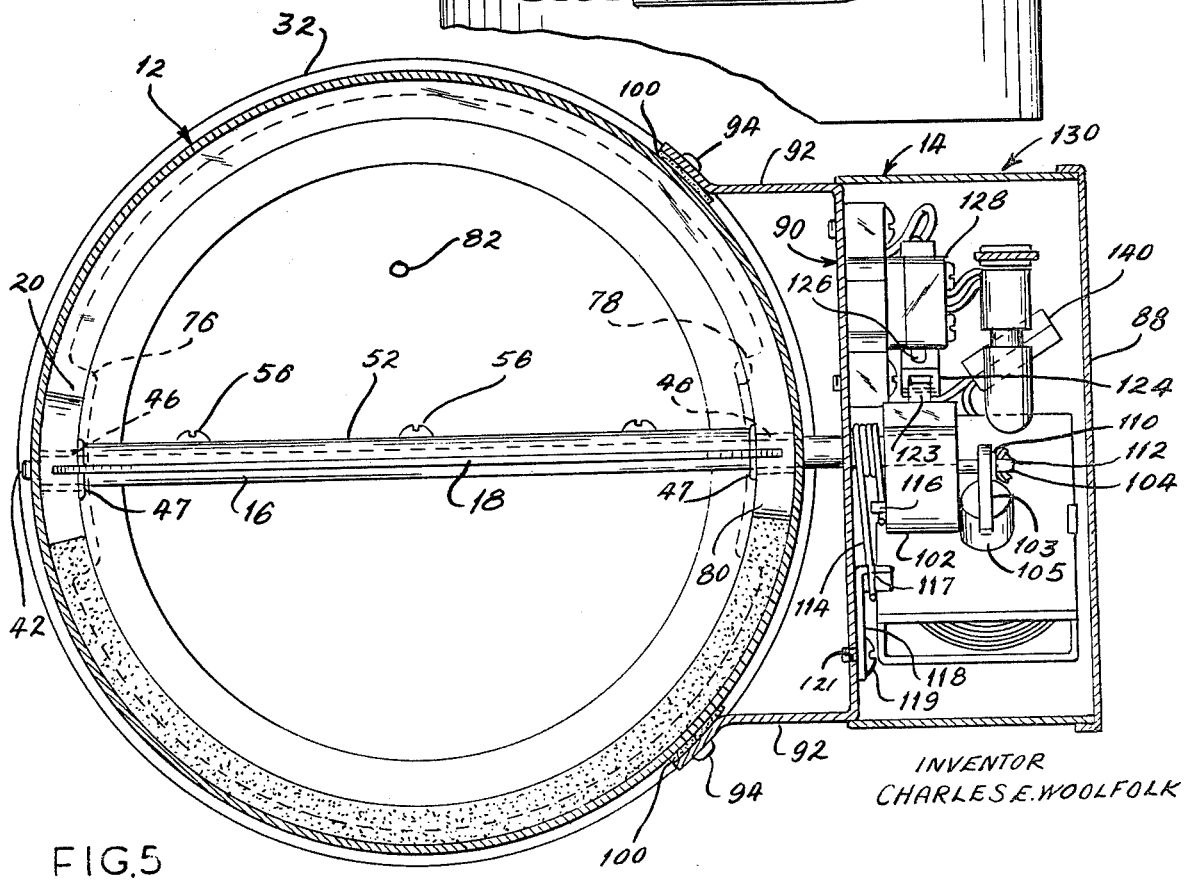
FIG. 5 is a cross-sectional view taken on line 5—5 of FIG. 4; and, FIG. 6 is a schematic circuit diagram of the present device including showing in dotted lines the connections to an associated furnace device.

The control assembly 14 is mounted on one side of the flue assembly 12 and is enclosed by a housing 88 which includes a bracket member 90 having spaced legs 92 which are fixedly attached to the flue sections 22 and 24 by rivets 94. The bracket 90 also has spaced upper and lower flanges 96 and 98 which extend outwardly away from the flue section 12 to form the upper and lower walls of the housing 88 for the control assembly 14. The rivets 94 in addition to attaching the bracket 90 to the flue sections 22 and 24 also help attach the flue sections together. The rivets 94 are preferably of the closed end or solid type so that no gases can escape from the flue assembly 12 therethrough. As can be seen in FIG. 5, the construction of the bracket 90 is such that it supports the control assembly 14 in spaced relationship to the flue section 12 which is desirable since this spacing prevents the operating parts of the control assembly 14 from being directly exposed to the relatively high temperatures that may be present in the flue. This means that the control assembly will remain relatively cool even at times when hot gases are being exhausted. A layer of insulating material 100 can optionally also be placed between the flue assembly 12 and the legs 92 of the control assembly 14 to further reduce the amount of heat that will be transferred to the control assembly 14 from the flue pipe assembly 12 although normally this is not necessary.

Figure 4:
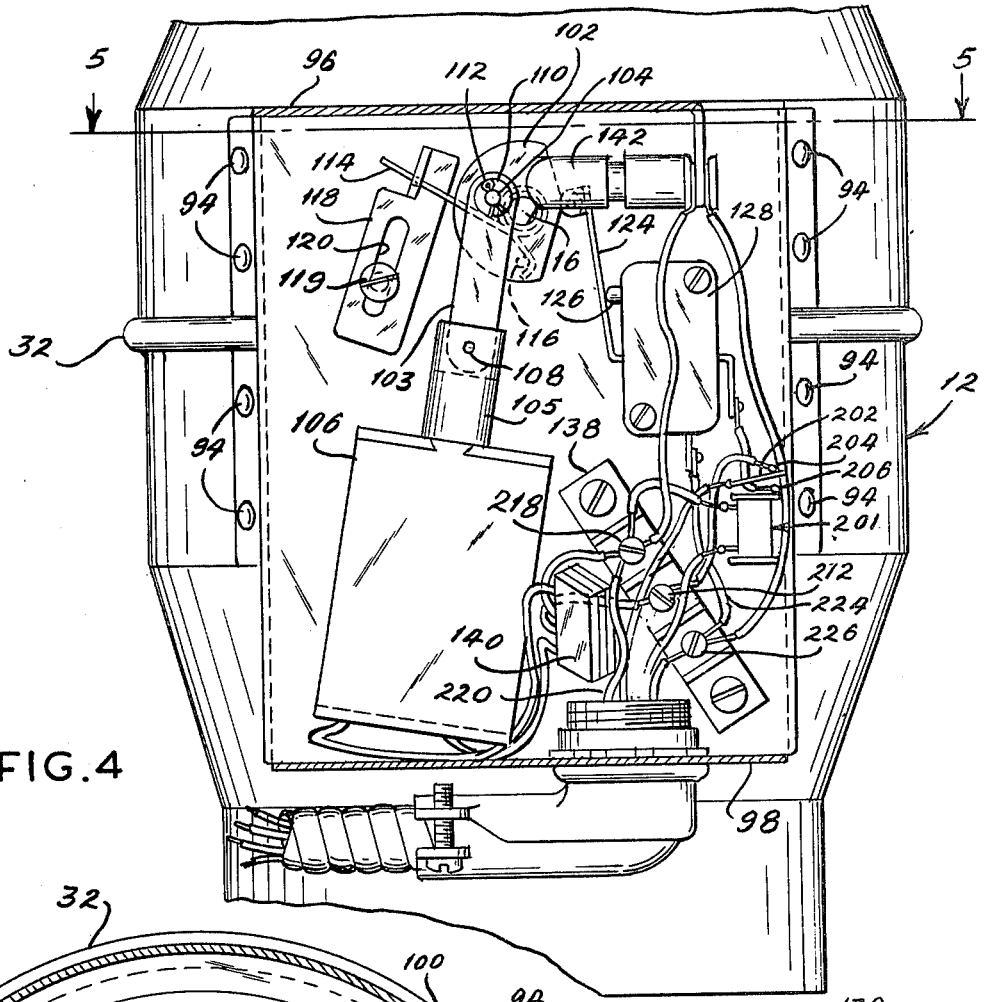
FIG. 4 is an enlarged fragmentary cross-sectional view taken on line 4—4 of FIG. 3.

The shaft 16 extends through the side of the flue assembly 12 and through the bracket 90 into the control assembly 14. The end of the shaft 16 whih extends into the control assembly 14 is preferably splined or flattened on one side as shown in FIG. 4, and attached thereto is a member 102 which serves as a cam to operate associated switch means and as a crank arm as will be explained. One end of a connecting rod 103 is pivotally attached to a pin 104 on the member 102 which pin 104 is located to be spaced from the axis of the shaft 16, and the opposite end of the connecting rod 103 is pivotally connected to a movable armature or plunger 105 of the solenoid assembly 106 by means of a pin member 108. The end of the rod 103 which is connected to the pin 104 is retained thereon by suitable means such as by washer 110 and cotter pin 112.

The cam member 102 and the damper plate 18 are biased in a normally clockwise position as shown in FIG. 4 by means of a torsion spring 114 which is mounted around the shaft 16 in the space between the cam member 102 and the adjacent wall formed by the bracket 90. One end of the torsion spring 114 is anchored to the cam member 102 by a stud 116 attached thereto and the opposite end of the spring 114 projects outwardly from the shaft 16 and is held in a desired tensioned condition by being restrained in a slot 117 formed in a bracket member 118, the position of which is adjustable by means of a threaded member 119 which extends through an elongated slot 120 in the member 118 and into a threaded hole 121 in the bracket member 90. The position of the bracket member 118 can be changed as desired to provide the desired spring tension. The spring 114 should preferably be formed of a material such as stainless steel which retains its spring characteristics and also is resistant to deterioration and corrosion. The bracket member 118 can also be substituted for by a simple tab 122 (FIG. 3) formed by a knockout in the bracket member 90. The slot 117 in the adjustment member 118 or the tab 122, if used, should preferably be such as to allow the restrained end of the spring 114 to relatively easily move longitudinally therein to prevent the spring from binding during movement of the shaft 16 and to minimize radial stresses which otherwise might cause the spring 114 to fatigue, break or to lose its more or less linear operating characteristics.

When the solenoid 106 is energized, the solenoid armature 105 and the pivotally attached connecting rod 103 are moved downwardly as shown in FIG. 4. This in turn causes counterclockwise rotation of the cam member 102 and the shaft 16, and it also causes the damper plate 18 to move from its open to its closed position as shown in dashed outline in FIG. 2. This is opposite from the movement of the damper plate in the patented construction which moves from its closed to its open position under the same set of conditions. This is also the reason that the positions of the off-set frame portions 62 and 64 must be reversed as described and necessitates changes in the circuitry as will be explained. Thereafter, when the solenoid 106 is deenergized the armature 105 will move upwardly by the biasing action of the spring 114 and the damper plate 18 will also return to its open position. Spring means (not shown) may also be included in the solenoid 106 or on the member 105 between the solenoid body 106 and the pivot 108 to bias the armature 105 to the deenergized position described. Such spring means may be used in addition to or instead of the spring 114. As a still further safety feature the damper plate 18 may optionally also include a weight such as weight 125 (FIGS. 2 and 3) attached thereto in position to urge it toward the open position.

The most important difference between the subject device and the device disclosed in U.S. Pat. No. 3,580,238 is that with the present device almost any conceivable failures will result in the damper plate assuming its normally open position. This means that the furnace or other device will be able to operate in the usual manner so that there will be no loss of service, but if a failure occurs it may be necessary to make a repair or parts replacement to place the automatic damper back in operation.

It is also important to note that when the present device is used with a furnace or other device which operates with combustion and non-combustion cycles, that the device drains very little current even when the solenoid 106 is energized so that the cost in electricity is minimal in relation to the savings in fuel cost by being able to close the furnace outlet during non-combustion cycles to prevent the undesirable escape of the heat produced in the furnace during the previous combustion cycle. Thus, it is possible to control the action of the damper plate 18, making it close upon energizing the solenoid 106 and open with the power of the spring 114 and/or the solenoid spring, when used, when the solenoid 106 is deenergized.

Figure 6:
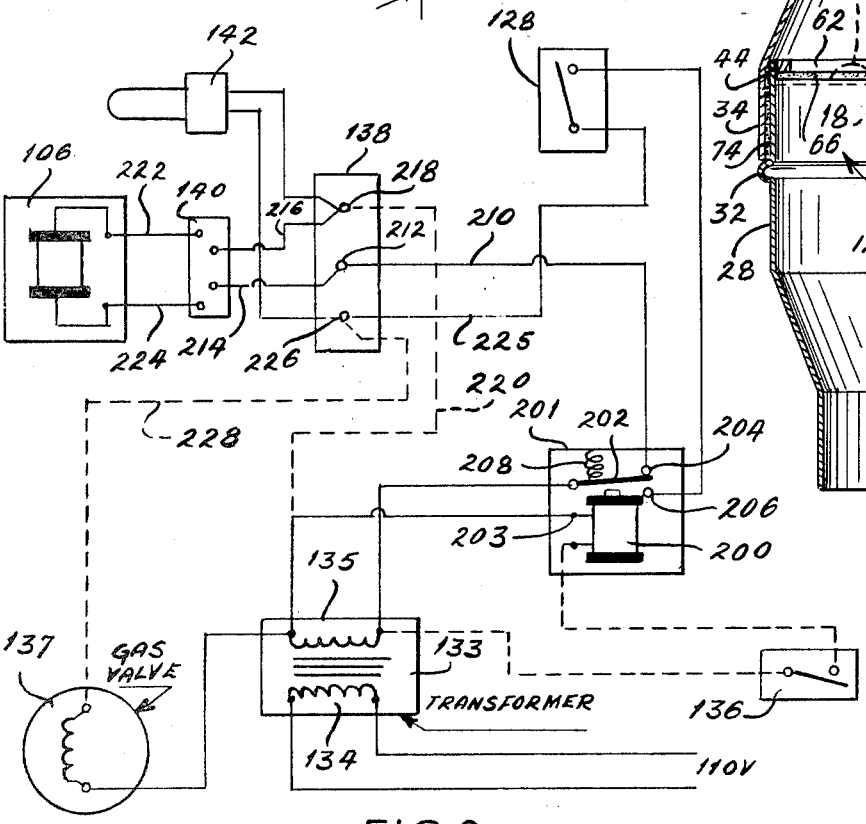

Referring more particularly to FIG. 6, there is shown a circuit for operating the subject device 10. The circuit includes portions in solid lines which are included in the present device and other portions in dotted lines which are more closely associated with the furnace, water heater, air conditioner or other device with which the subject device is used. When the subject device is used on a gas furnace, power is fed to the device through a step down transformer such as transformer 133 which has a primary winding 134 connected to the source and a secondary winding 135 which is shown connected to several circuits including a series circuit which includes a thermostatically controlled switch 136 which closes when the temperature in the environment being controlled falls below some predetermined temperature as determined by the setting of the thermostat (not shown). The switch 136 is in series with a relay coil 200 of relay 201 across the secondary winding 135 so that whenever the thermostat switch 136 closes the relay coil 200 will be energized and in so doing will move the movable relay contact 202 from a position engaging stationary relay contact 204 to a position engaging stationary relay contact 206. Note that the relay 201 will always be energized when the thermostat switch 136 is closed.

The secondary transformer winding 135 also has a connection to the movable relay contact 202 and when the relay is deenergized the movable contact 202 will be biased by spring 208 into engagement with stationary relay contact 204 to establish a circuit on lead 210 to contact 212 on terminal strip 138. The same terminal strip contact 212 is connected by lead 214 to one input of rectifier 140 and the other input connection to the rectifier 140 is made by lead 216 to terminal strip contact 218. The contact 218 is in turn connected by dotted lead 220 to the opposite side of the transformer secondary 135. The rectifier 140 has its outputs 222 and 224 connected across the coil of the solenoid 106. With the circuit connected as described the solenoid 106 will be energized at all times except when the thermostat switch 136 closes to call for heat. With the solenoid 106 energized the damper plate 18 will be closed to prevent escape of hot gases from the furnace.

When the thermostat switch 136 closes meaning that more heat is required, and hence furnace combustion is called for, the relay coil 200 will be energized as aforesaid and this will cause the movable relay contact 202 to move in opposition to the spring 208 out of engagement with the relay contact 204 and into engagement with the relay contact 206. This will establish circuit from the transformer secondary winding 135 through the relay contacts 202 and 206 to the normally open cam controlled switch 128, and from there by way of lead 225 to the terminal contact 226. The contact 226 has another connection by dotted lead 228 to the gas valve motor or solenoid 137 which is part of the furnace. The other side of the gas valve motor 137 is connected to the opposite side of the transformer secondary 135. This means that for the gas valve to be energized to supply gas to the furnace, the relay 201 must be energized and the solenoid 106 must be deenergized. This is because only when the solenoid 106 is deenergized will the cam 102 be in a position closing the contacts of the switch 128. Hence, during combustion the solenoid 106 is deenergized and the damper plate 18 is in its open position enabling the products of combustion to escape out to the chimney, and during noncombustion cycles the solenoid 106 will be energized to hold the damper plate 18 in its closed position preventing escape of heat from the furnace into the chimney.

The circuit may optionally also include a pilot bulb 142 which gives visual indication whenever the damper plate 18 is in its closed condition. The bulb 142 is connected between the terminal block contacts 218 and 226 and is energized whenever the relay 201 is energized and the cam operated switch 128 is closed. It is necessary for the relay 201 to be energized to establish contact between the relay contacts 202 and 206, and it is necessary for the switch 128 to also be closed to energize the bulb 142. The pilot bulb 142 when energized therefore provides a visual indication of the closed condition of the subject damper device.

It is now apparent that in order to energize the furnace gas valve 137 when the damper plate 18 is open, the position of the cam 102 must be adjusted so that the operating arm 124 of the switch 128 that engages the cam 102 will be such that the switch operator member 126 (FIG. 4) closes the contacts of the switch 128 and establish the circuit to energize the gas valve 137. This adjustment is made so that the gas valve can only be energized when the damper 18 is in its open position. The shape and location of the cam 102 and its engagement with the follower arm 124 must be preset at the factory for proper operation.

The size and current requirements of the relay 201 and the solenoid 106 are selected to be adequate for the purposes to be performed and yet should be minimal to reduce the operating cost. This can be achieved using commercially available devices which are selected because of their relatively low power requirements.

As can be seen in FIG. 1, a cover 130 is provided for enclosing the control means 14 to protect the mechanisms contained therein and to improve the appearance. The cover 130 is preferably also constructed of a material that is resistant to corrosion. Ventilation holes 131 are formed at upper and lower locations in the sides 132 of the cover 130 to allow air to circulate therein and to maintain the controls in a relatively cool condition.

The use of a D.C. solenoid instead of an A.C. solenoid in the present device is desirable for several reasons including the fact that D.C. solenoids operate at substantially lower noise and vibration levels, they are more efficient, they have longer life expectancy, and they are better able to withstand higher temperature environments. Also in the preferred form of the present device the solenoid armature 105 is coated with a dry type lubricant to reduce friction, to even further increase the life expectancy thereof, and to prevent seizure or sticking particularly when the device is operated after prolonged shutdowns such as at the end of the warmer months when the furnace has not been operating.

Inasmuch as the subject damper 10 is closed whenever the furnace or other associated combustion device is not in a combustion cycle, it acts to minimize escape of furnace heat as well as conditioned air in the surrounding room. The conditioned air may include warm room air in the winter time or cool conditioned air in the summer time. Also by being closed when the furnace or the like is not in a combustion cycle the subject device 10 prevents downdrafts caused by gusty conditions and otherwise as well as updrafts caused by convection and vacuum in the flue 13. Closing the exhaust flue 13 when the furnace is not in a combustion cycle also prevents downdrafts from blowing out the pilot light and may enable the pilot light to be operated on less fuel. In this way, use of the subject device results in a considerable savings in fuel costs in the winter, and in the summer reduces the cost of operating air conditioning equipment including central air conditioning equipment such as might be installed as part of a furnace or even separately installed.

Thus there has been shown and described a novel automatic damper device which fulfills all of the objects and advantages sought therefor. Many changes, modifications, variations and other uses and applications of the present device will, however, become apparent to those skilled in the art after considering this specification and accompanying drawings. All such changes, modifications, variations and other uses and applications which do not depart from the spirit and scope of the invention are deemed to be covered by the invention which is limited only by the claims which follow.

What is claimed is:

1. In a device to control the discharge of the products of combustion from a furnace or like device which has a burner and means including a solenoid operated control valve to control the supplying of fuel to the burner, the furnace also including an outlet tube through which the products of combustion can escape, the improvement comprising a damper control device including a tube member adapted to be installed in and as part of the outlet tube of the furnace, a reinforced means on said tube member to provide support therefor, a shaft journaled to the reinforcing means and having a first portion extending across the tube member and a second portion extending outwardly from said tube member, a damper plate attached to the first shaft portion and extending therefrom to adjacent the reinforcing means when in the closed position, means forming a crank arm on the second shaft portion, spring means operatively engageable with the crank arm biasing said crank arm and the shaft in a direction to move the damper plate away from the reinforcing means to an open position, motor means operatively connected to the crank arm for moving the damper plate from an open position away from the reinforcing means when said motor means is energized, switch means having an actuating member operatively engageable with the crank arm, said switch means going from one position when the damper plate is in an open position to a different position when the damper plate is in a closed position, said spring means effecting movement of said damper plate to an open position whenever said motor means is de-energized, the furnace cycling being controlled by thermostatically controlled switch means and a relay having a relay coil and relay contacts, means connecting the relay coil in series with the thermostatically controlled switch means whereby the relay coil is energized whenever the thermostatically controlled switch means are closed, said relay contacts including first relay contact means in circuit with the motor means for energizing the motor means, and second relay contact means in circuit with the solenoid operated control valve means on the furnace to enable energizing of the valve means whenever the relay coil is energized.

2. In the device defined in claim 1 including means connecting the switch means in circuit with the second relay contact means and with the solenoid operated valve means.

3. In the device defined in claim 1 means forming a housing attached to the tube member, and means mounting the motor means, the crank arm, the switch means and the relay in the housing.

* * * * *

UNITED STATES PATENT OFFICE

CERTIFICATE OF CORRECTION

Patent No. 4,249,883 Dated February 10, 1981

Inventor(s) Charles E. Woolfolk

It is certified that error appears in the above-identified patent and that said Letters Patent are hereby corrected as shown below:

Column 6, line 50 "whih" should be --which--.

Signed and Sealed this

Nineteenth Day of May 1981

[SEAL]

Attest:

RENE D. TEGTMEYER

Attesting Officer

Acting Commissioner of Patents and Trademarks